US005765691A

United States Patent [19]

Hall

[11] Patent Number: 5,765,691

[45] Date of Patent: Jun. 16, 1998

[54] TRAVELING GOLF SET

[76] Inventor: Jeffrey L. Hall, 1015 Beach Ave., Torrance, Calif. 90501

[21] Appl. No.: 890,872

[22] Filed: Jul. 10, 1997

[51] Int. Cl.[6] ..... A63B 53/00; A63B 55/00

[52] U.S. Cl. ..... 206/579; 383/2; 473/287; 473/299; 206/315.3

[58] Field of Search ..... 473/239, 288, 473/296, 298, 299, 287; 248/96; 206/315.1, 315.2, 315.3, 579; 383/2, 4, 118

[56] References Cited

U.S. PATENT DOCUMENTS

| | | | |
|---|---|---|---|
| 2,729,257 | 1/1956 | Kepper | 383/2 |
| 3,829,092 | 8/1974 | Arkin | 473/239 |
| 4,340,227 | 7/1982 | Dopkowski | 473/288 |
| 4,509,643 | 4/1985 | Rhee | 206/315.8 |
| 4,635,793 | 1/1987 | Kim | 206/315.6 |
| 4,664,382 | 5/1987 | Palmer | 473/288 |
| 5,638,954 | 6/1997 | Hsien | 206/315.3 |

FOREIGN PATENT DOCUMENTS 2220576 1/1990 United Kingdom .

*Primary Examiner*—Sebastiano Passaniti
*Assistant Examiner*—Stephen L. Blau

[57] ABSTRACT

A traveling golf club kit which enables a user to easily transport a set of golf clubs. In its broadest context the present invention includes a collapsible golf bag and a set of clubs, wherein each of the clubs has an assembled configuration and a disassembled configuration. The various components of the present invention, and the manner in which they interrelate, will be described in greater detail hereinafter.

4 Claims, 3 Drawing Sheets

TRAVELING GOLF SET

BACKGROUND OF THE INVENTION

1. Field of the Invention

The present invention relates to a golf club travel kit and more particularly pertains to such a kit with a collapsible golf club bag and individual clubs which can be disassembled.

2. Description of the Prior Art

The use of a golf clubs is known in the prior art. More specifically, such golf clubs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,943,059 to Morell discloses a golf club having a removable head. U.S. Pat. No. 5,433,442 to Walker discloses a golf club with a quick release head. U.S. Des. Pat. No. 423,251 to Morrisseau discloses a golf club design. U.S. Pat. No. 5,334,101 to McDermott discloses a connector for a detachable billiard cue. U.S. Pat. No. 4,231,574 to Williams discloses a billiard cue having a quick connector for the handle portion. Lastly, U.S. Pat. No. 4,696,498 to Church discloses a tubular connector.

In this respect, the golf club kit substantially departs from the conventional concepts and designs of the prior art, and in so doing provides an apparatus primarily developed for the purpose of easily transportion golf clubs.

Therefore, it can be appreciated that there exists a continuing need for making golf easier to play. In this regard, the present invention substantially fulfills this need.

SUMMARY OF THE INVENTION

In view of the foregoing disadvantages inherent in the known types of golf clubs now present in the prior art, the present invention provides a golf club kit with enables a set of clubs to be easily transported. As such, the general purpose of the present invention, which will be described subsequently in greater detail, is to enable a user easily transport a set of golf clubs.

To attain this, the present invention essentially comprises a golf club traveling kit which includes a set of clubs with each club of the set comprising, a handle, shaft and club head. Each handle portion has an upper end and a lower end and a grip portion therebetween. Each shaft portion has an upper end and a lower end and an intermediate extent therebetween. The lower end of the handle portion is removably coupled to the upper end of the shaft portion by way of a first threaded coupling means. The club head portion has an upper end and a lower end, with the upper end of the club head portion being removably coupled to the lower end of the shaft portion by way of a second threaded coupling means. Thus, each of the clubs has an assembled configuration, wherein the handle, shaft, and club head portions are interconnected, and an disassembled configuration wherein the handle, shaft and club head portion are disconnected. The kit also includes carrying bag having an open upper end, a closed lower end and an intermediate extent therebetween. The intermediate extent is formed of a flexible nylon material, with a first Velcro fastening means secured to the intermediate extent adjacent to open upper end, and a second Velcro fastening means secured to the intermediate extent adjacent to the closed lower extent. The carrying bag has a collapsed configuration wherein the first fastening means is secured to the second fastening means and the nylon material is folded therebetween. The bag also having an uncollapsed configuration wherein the nylon material is unfolded. The bag, when in the uncollapsed configuration, is adapted to receive the set of clubs in the assembled configuration, and the bag, when in the collapsed configuration, is adapted to receive the set of clubs in the unassembled configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved traveling golf club set.

It is another object of the present invention to provide a kit, wherein both the clubs and bag have a disassembled or collapsed configuration.

It is a further object of the present invention to provide a threaded coupling means for assembling a golf club.

An even further object of the present invention is to golf club kit which is susceptible of a low cost of manufacture with regard to both materials and labor, and which accordingly is then susceptible of low prices of sale to the consuming public, thereby making such toilet seat raising and lowering device economically available to the buying public.

Still yet another object of the present invention is to provide a golf club kit which provides in the apparatuses and methods of the prior art some of the advantages thereof, while simultaneously overcoming some of the disadvantages normally associated therewith.

Lastly, it is an object of the present invention to provide a new and improved traveling golf club kit which enables a user to easily transport a set of golf clubs. In its broadest context the present invention includes a collapsible golf bag and a set of clubs, wherein each of the clubs has an assembled configuration and a disassembled configuration. The various components of the present invention, and the manner in which they interrelate, will be described in greater detail hereinafter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view of the golf bag in its collapsed configuration in:

Similar reference characters refer to similar parts throughout the several views of the drawings.

DESCRIPTION OF THE PREFERRED EMBODIMENT

Figure 1:
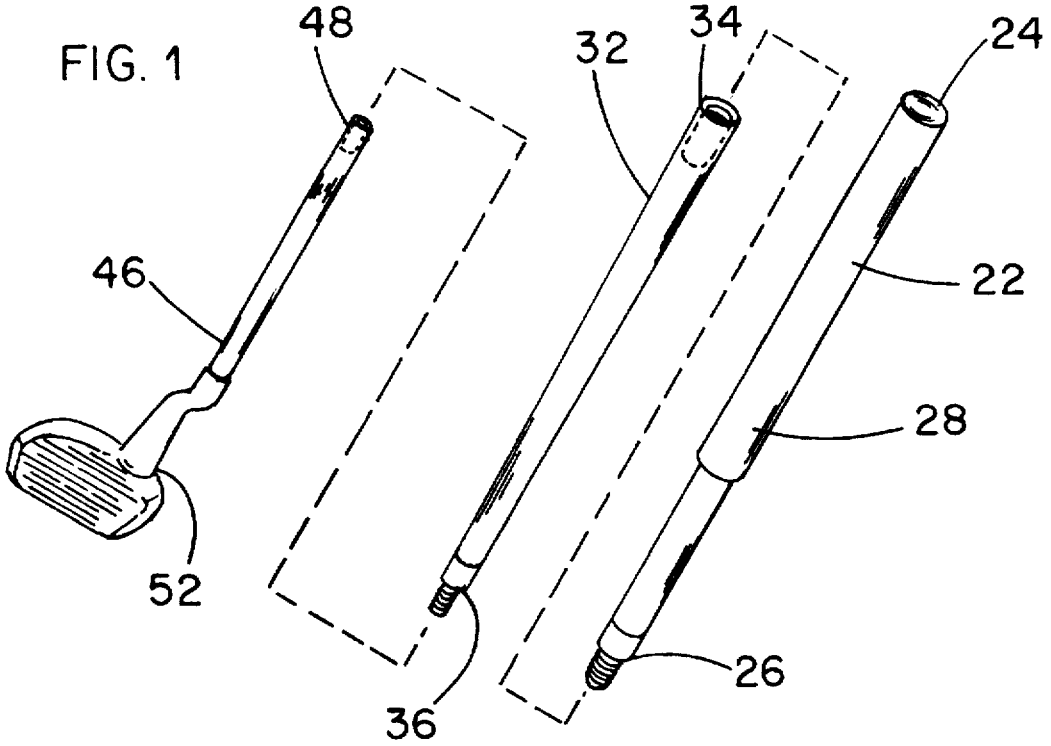
FIG. 1 is a view of an individual club in its disassembled configuration.
Figure 2:
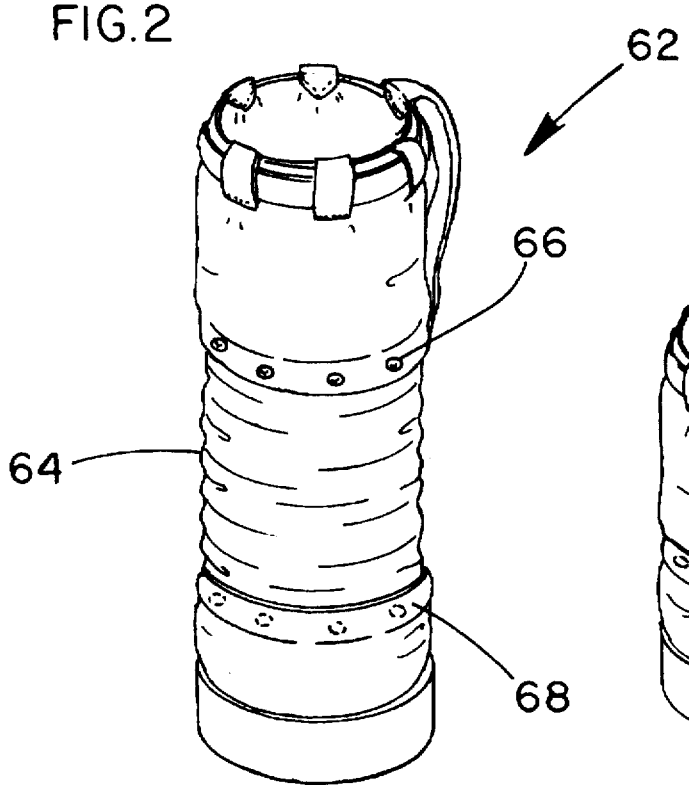
FIG. 2 is a view of the golf bag in its uncollapsed configuration.
Figure 3:
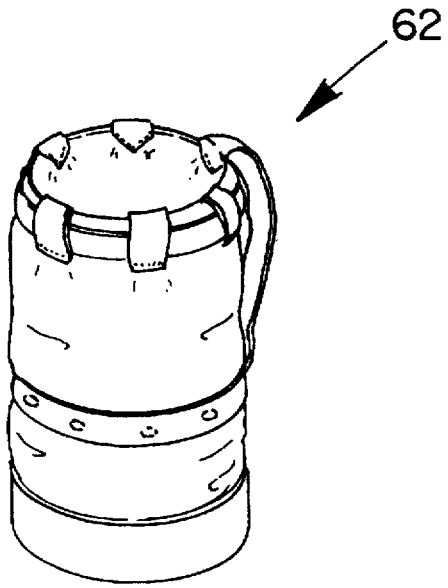
Figure 4:
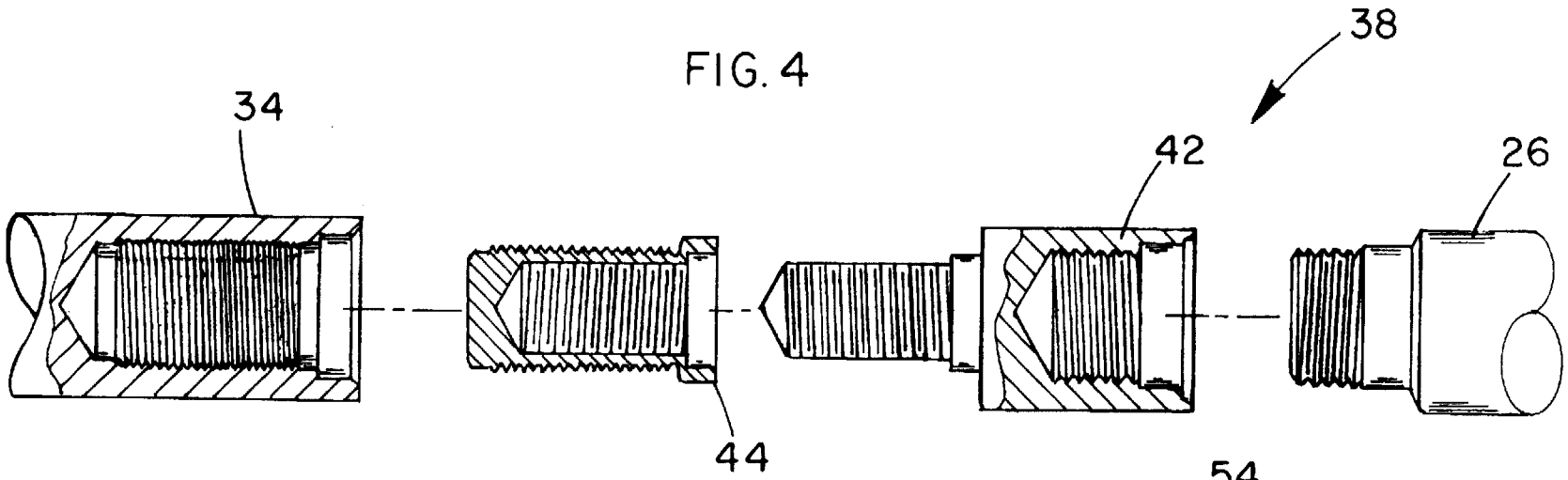
FIG. 4 is an exploded view of the first threaded coupling means.
Figure 5:
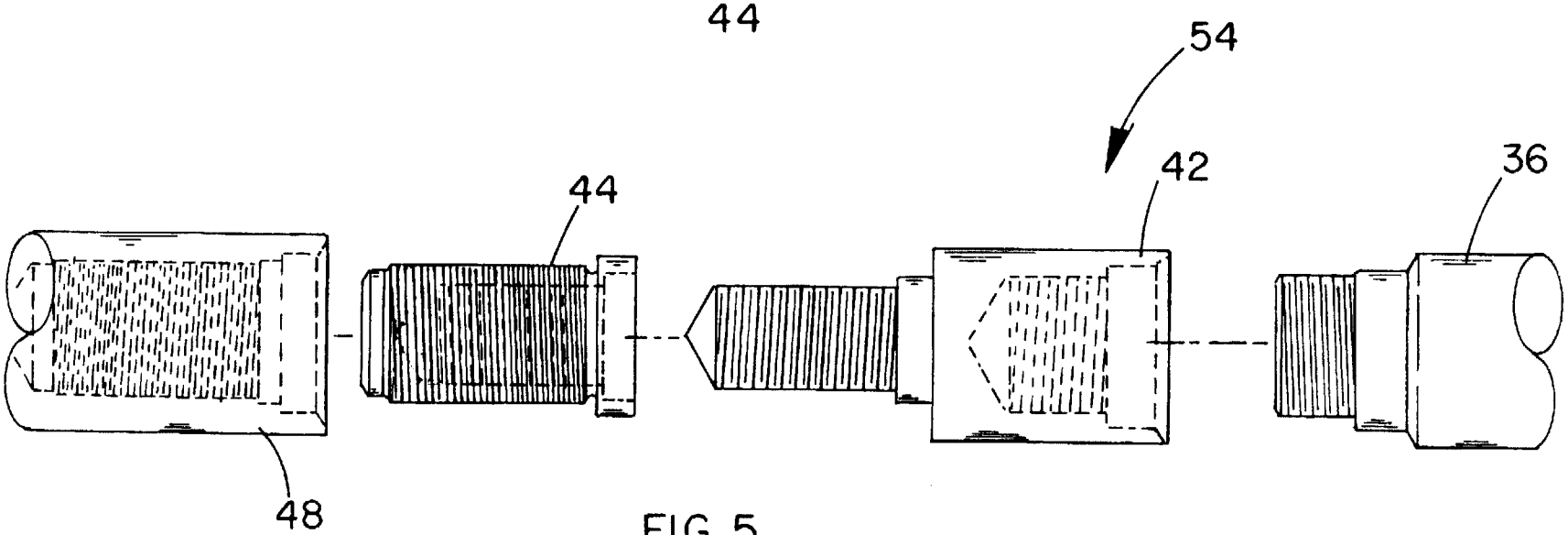
FIG. 5 is an exploded view of the second threaded coupling means.
Figure 6:
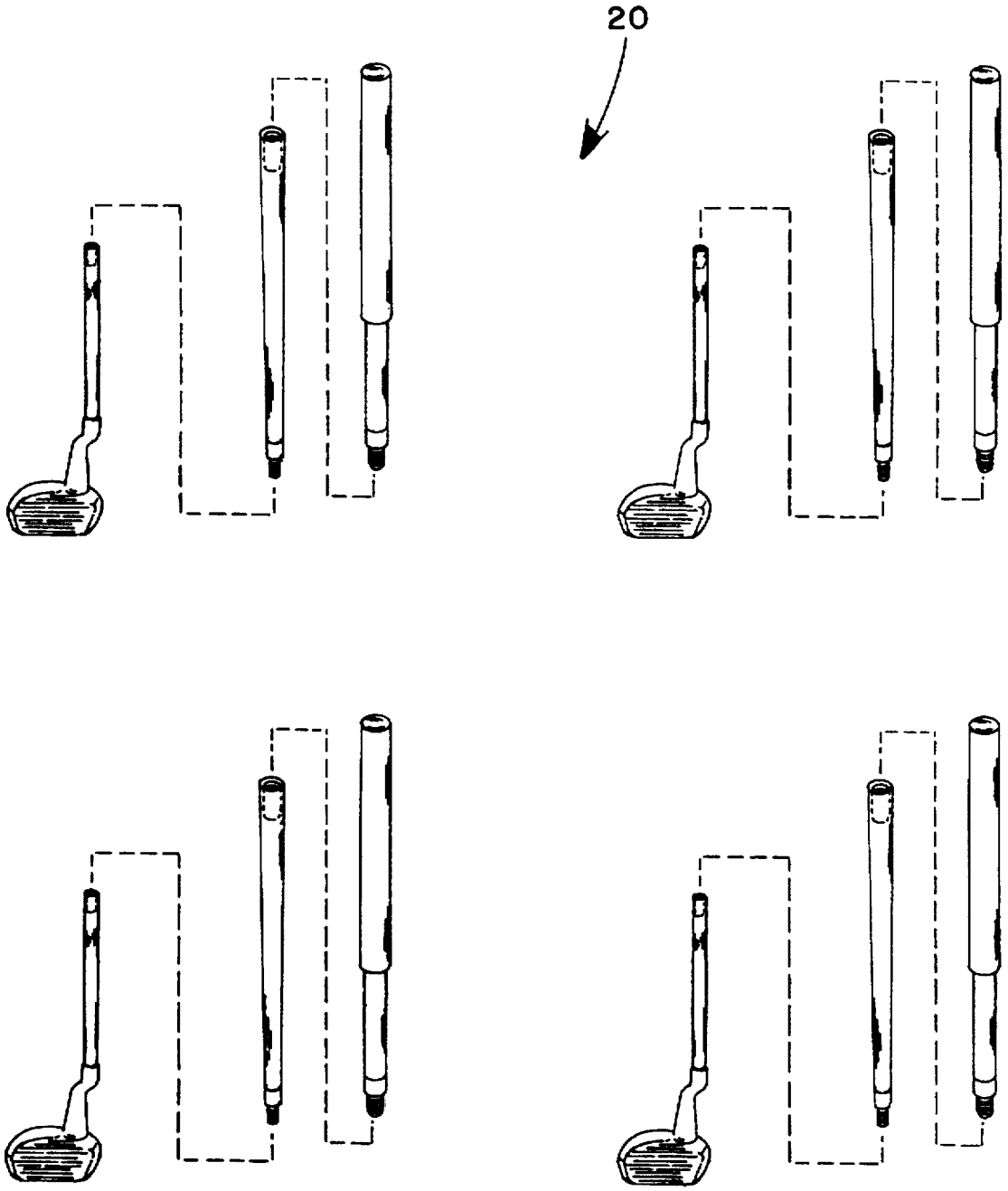
FIG. 6 is a view of the set of golf clubs of the present invention.

The present invention relates to a traveling golf club kit which enables a user to easily transport a set of golf clubs. In its broadest context the present invention includes a collapsible golf bag and a set of clubs, wherein each of the clubs has an assembled configuration and a disassembled configuration. The various components of the present invention, and the manner in which they interrelate, will be described in greater detail hereinafter.

The present invention finds particular application in conjunction with a set of golf clubs 20. Specifically, a conventional set of golf clubs: putter, wedge, nine iron, eight, iron, seven iron, six iron, five iron, four iron, three iron, two iron, three wood, and driver. However, the present invention can be employed with a number of clubs.

Each club of the set, however, can be dissambled into a traveling configuration. The details of one club of the set will be described hereinafter.

Namely, each club of the set includes a handle portion 22, a shaft portion 32 and a club head portion 46. The handle portion 22 includes an upper end 24 and a lower end 26 and a grip portion 28 therebetween. The shaft portion 32 likewise includes an upper end 34 and a lower end 36 and an intermediate extent therebetween. The lower end 26 of the handle portion 22 is adapted to be removably coupled to the upper end 34 of the shaft portion 32 by way of a first threaded coupling means 38. The details to this threaded coupling means will be described in greater detail hereinafter.

The club head portion 46 has an upper end 48 and a lower end 52. The upper end 48 of the club head portion 46 is adapted to be removably coupled to the lower end 36 of the shaft portion 32 by way of a second threaded coupling means 54.

The first 38 and second 54 coupling means are identical to one another will be described hereinafter. Specifically, each coupling means includes two parts. A first part 42 which includes an interior threaded portion and an exterior threaded portion; and a second part 44 which also includes an interior threaded portion and an exterior threaded portion. The interior threaded portion of the first part is adapted to be coupled to a male threaded portion of the golf club. Furthermore, the exterior threaded portion of the second part is adapted to be coupled to a female threaded portion of the golf club. To ensure a secure fit each set of threads is reversed from the adjacent set.

Thus, each of the clubs has an assembled configuration wherein the handle 22, shaft 32 and club head portion 46 are interconnected, and an disassembled configuration wherein the handle 22, shaft 32 and club head portion 46 are disconnected.

The kit of the present invention also includes a carrying bag 62. The bag 62 has an collapsed configuration and an uncollapsed configuration. The carrying bag 62 has an open upper end, a closed lower end and an intermediate extent therebetween. The intermediate extent, in the preferred embodiment, is formed of a flexible nylon material 64. The bag 62 also includes two fastening means used to keep the bag in its collapsed configuration. Specifically, the bag includes a first hook and loop fastening means 66 secured to the intermediate extent adjacent to open upper end, and a second hook and loop fastening means 68 secured to the intermediate extent adjacent to the closed lower extent. The hook and loop fastening means are commonly known under the trade name Velcro. The bag's collapsed configuration is achieved by securing the first fastening means 66 to the second fastening means 68 such that the nylon material 64 is folded therebetween. The bag's uncollapsed configuration is achieved by separating the fastening means such that the nylon material is unfolded.

The bag 62, when in the uncollapsed configuration, is adapted to receive the set of clubs with each of the clubs in their assembled configuration. Alternatively, when the bag 62 is in the collapsed configuration it is adapted to receive the set of clubs with each of the clubs in the unassembled configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf club traveling kit comprising in combination:

a set of clubs with each club of the set comprising;

a handle portion having an upper end and a lower end and a grip portion therebetween;

a shaft portion having an upper end and a lower end and an intermediate extent therebetween, the lower end of the handle portion being removably coupled to the upper end of the shaft portion by way of a first threaded coupling means;

a club head portion having an upper end and a lower end, the upper end of the club head portion being removably coupled to the lower end of the shaft portion by way of a second threaded coupling means;

each of the clubs having an assembled configuration wherein the handle, shaft and club head portion are interconnected, and an disassembled configuration wherein the handle, shaft and club head portion are disconnected;

a carrying bag having an open upper end, a closed lower end and an intermediate extent therebetween, the intermediate extent being formed of a flexible nylon material, a first hook and loop fastening means secured to the intermediate extent adjacent to open upper end, a second hook and loop fastening means secured to the intermediate extent adjacent to the closed lower extent, the carrying bag having a collapsed configuration wherein the first fastening means is secured to the second fastening means and the nylon material is folded therebetween, the bag also having an uncollapsed configuration wherein the nylon material is unfolded;

the bag, when in the uncollapsed configuration, is adapted to receive the set of clubs in the assembled configuration, and the bag, when in the collapsed configuration, is adapted to receive the set of clubs in the unassembled configuration.

2. A golf club traveling kit comprising in combination:

a set of clubs with each club of the set comprising;

a handle portion having an upper end and a lower end and a grip portion therebetween;

a shaft portion having an upper end and a lower end and an intermediate extent therebetween, the lower end of the handle portion being removably coupled to the upper end of the shaft portion by way of a first coupling means;

a club head portion having an upper end and a lower end, the upper end of the club head portion being removably coupled to the lower end of the shaft portion by way of a second coupling means;

each of the clubs having an assembled configuration wherein the handle, shaft and club head portion are interconnected, and an disassembled configuration wherein the handle, shaft and club head portion are disconnected;

a carrying bag having an open upper end, a closed lower end and an intermediate extent therebetween, the intermediate extent being formed of a flexible material, a first fastening means secured to the intermediate extent adjacent to open upper end, a second fastening means secured to the intermediate extent adjacent to the closed lower extent, the carrying bag having a collapsed configuration wherein the first fastening means is secured to the second fastening means and the flexible material is folded therebetween, the bag also having an uncollapsed configuration wherein the flexible material is unfolded;

the bag, when in the uncollapsed configuration, is adapted to receive the set of clubs in the assembled configuration, and the bag, when in the collapsed configuration, is adapted to receive the set of clubs in the unassembled configuration.

3. The traveling golf club kit as described in claim 2 wherein:

the flexible material of the intermediate extent of the bag is nylon; and the first and second fastening means of the bag are a hook and loop fastening means.

4. The traveling golf club kit as described in claim 2 wherein:

the first and second club fastening means are threaded fasteners.

* * * * *